US006237509B1

(12) United States Patent
Ishido et al.

(10) Patent No.: US 6,237,509 B1
(45) Date of Patent: May 29, 2001

(54) SYNTHETIC RESIN PALLET

(75) Inventors: Satoshi Ishido; Yuzo Hayakawa; Isami Koyama, all of Ueda (JP)

(73) Assignees: Nippon Plastic Pallet Corporation, Ueda; Mitsubishi Chemical Corporation; Dainippon Ink and Chemicals, Inc., both of Tokyo, all of (JP)

( * ) Notice: Subject to any disclaimer, the term of this patent is extended or adjusted under 35 U.S.C. 154(b) by 0 days.

(21) Appl. No.: 09/425,299

(22) Filed: Oct. 25, 1999

(30) Foreign Application Priority Data

Oct. 26, 1998 (JP) ..... 10-304462
Sep. 20, 1999 (JP) ..... 11-266326

(51) Int. Cl.[7] ..... B65D 19/38

(52) U.S. Cl. ..... 108/57.25; 108/57.29; 108/901

(58) Field of Search ..... 108/57.12, 57.18, 108/57.21, 57.22, 57.25, 57.27, 57.34, 901, 57.29

(56) References Cited

U.S. PATENT DOCUMENTS

| | | | | |
|---|---|---|---|---|
| 3,678,868 | * | 7/1972 | Hirota | 108/901 X |
| 4,183,491 | | 1/1980 | Sanders et al. . | |
| 4,397,246 | * | 8/1983 | Ishida et al. | 108/901 X |
| 4,824,129 | * | 4/1989 | Rehrig | 108/901 X |
| 5,046,434 | * | 9/1991 | Breezer et al. | 108/57.27 |
| 5,080,960 | * | 1/1992 | Smorada | 108/901 X |
| 5,255,613 | | 10/1993 | Shuert . | |
| 5,868,080 | | 2/1999 | Wyler et al. . | |
| 5,960,721 | * | 10/1999 | Huetteman et al. | 108/57.21 X |
| 5,967,057 | * | 10/1999 | Nakayama et al. | 108/57.25 |

FOREIGN PATENT DOCUMENTS

| | | | | |
|---|---|---|---|---|
| 2145652 | * | 3/1973 | (DE) | 108/901 |
| 41 42 659 | | 6/1993 | (DE) . | |
| 27 33 456 | | 2/1979 | (EP) . | |
| 0 068 586 | | 1/1983 | (EP) . | |
| 0 116 528 | | 8/1984 | (EP) . | |
| 0 945 356 | | 9/1999 | (EP) . | |
| 2544287 | * | 10/1984 | (FR) | 108/901 |
| 2 209 321 | | 5/1989 | (GB) . | |
| 0199446 | * | 11/1984 | (JP) | 108/901 |
| 403256846 | * | 11/1991 | (JP) | 108/901 |
| WO 97/33798 | | 9/1997 | (WO) . | |

* cited by examiner

*Primary Examiner*—Peter M. Cuomo
*Assistant Examiner*—Hanh V. Tran
(74) *Attorney, Agent, or Firm*—Oblon, Spivak, McClelland, Maier & Neustadt, P.C.

(57) ABSTRACT

A synthetic resin pallet capable of enhancing a strength against a bending force acting in a direction right-angled to a loading surface without an increase in weight of the whole pallet. The synthetic resin pallet is constructed such that pallet constructive members taking configurations of the pallet being divided into upper and lower members are formed by, e.g., injection molding, then set facing to each other and integrally welded. A reinforced tape using a fiber reinforced material which is bendable is attached for reinforcement by the heat welding inside a groove formed on a surface of any one or both of the pallet constructive members in order to resist a bending force acting in a direction orthogonal to the surface thereof.

5 Claims, 12 Drawing Sheets

SYNTHETIC RESIN PALLET

BACKGROUND OF THE INVENTION

1. Field of the Invention

The present invention relates to a synthetic resin pallet and more particularly to a pallet for a forklift used for carrying, moving and storing goods.

2. Description of the Related Art

A pallet for a forklift, which is composed of a synthetic resin, has hitherto been manufactured and used. There are a various types of synthetic resin pallets. One method of forming the synthetic resin pallet may be exemplified by a method of forming top and bottom pallet constructive members divided by two in a height wise direction by injection molding, then setting leg (block) constructive members in these pallet constructive members facing to each other, fitting them to each other, and integrally welding the fitted portions thereof by heat.

Each of the top and bottom pallet constructive members includes a plate member, leg constructive members provided in proper positions on an internal surface of this plate member, and reinforced ribs provided in lattice intersecting lengthwise and crosswise on the internal surface of the plate member. The "plate member" is a high-order conceptual term, and literally implies a plate-like portion having a comparatively broad surface. Especially the plate member designed for loading a goods on its surface is referred to as a loading surface, i.e., a deck board.

Accordingly, in the case of the synthetic resin pallet of which both surfaces are used, these two plate members are defined as the deck boards. In the case of the synthetic resin pallet of which one single surface is used, the plate member for loading the goods is in particular called the deck board, while the other surface is simply termed the plate member.

The reinforced ribs are formed in lattice on the internal surface of the plate member of each of the pallet constructive members. The reinforced rib is well known as what is extremely effective in terms of enhancing a flexural strength of the plate member and preventing a flexure from occurring in the plate member, especially the deck board when a load is carried and moved by a forklift.

The reinforced rib described above has an advantage of enhancing the flexural strength of the plate member of each of the pallet constructive members, and also has an advantage of increasing a strength against a fracture in the vicinity of a fork insertion hole of the synthetic resin pallet, which might easily be fractured by an impingement of the fork tines. Accordingly, the reinforced ribs are formed over the entire surface of the plate member of each of the pallet constructive members constituting the synthetic resin pallet.

Incidentally, the goods are stored for a certain period of time in an automated warehouse as the case may be. In that case, the synthetic resin pallets loaded with the goods are stored while being supported by a rack device in the automated warehouse. The automated warehouse generally has a mechanism for picking up the synthetic resin pallet from under by a stacker crane, and therefore in great majority of cases takes a "two-point support rack structure" for supporting the synthetic resin pallet at only right-and-left ends thereof.

In the pallet formed of the synthetic resin, however, if a considerable time has elapsed in a state where a load is applied to the pallet, a fatigue phenomenon known as a "creep", i.e., a flexure occurs. The occurrence of this flexure will be explained in much greater details. As shown in FIG. 15, the flexure occurs when supporting the two ends of the pallet in the state where the goods are placed on the synthetic resin pallet. In that case, as indicated by arrowheads 28*a*, 28*b* in FIG. 15, the surface of the deck board is compressed by the flexure, while the plate member on the underside is stretched, thus deforming the synthetic resin pallet.

The occurrence of this flexure is a conspicuous phenomenon with macromolecules. Therefore, the creep, viz., the flexure occurred in the synthetic resin pallet can not be eliminated in terms of its material, and hence the conventional synthetic resin pallet has been contrived to reduce the creep deflection by physical means.

As one example thereof, there has been known a method of enhancing strength against bending force acting in a direction right-angled to the surface of the deck board by such a structure that a rigid body such as elongate steel bars or fiber reinforced plastics bars is embedded extending in bilateral directions of the pallet inwardly of the deck board of the synthetic resin pallet. This method, however, has a defect that a weight of the synthetic resin pallet is extremely heavy, and also presents a problem that a crack is easily produced in the resinous portion peripheral to the steel core embedded therein.

Further, when the rigid body such as the steel core is so disposed as to be embedded in the synthetic resin pallet, a problem is that a deviation and an air gap might occur due to a repetitive stress between the rigid body and the peripheral resinous portion, and eventually the crack occurs around the rigid-body-embedded portion in the synthetic resin pallet. Those problems arise because the synthetic resin pallet by nature bends or deflects to some extent by the load as described above, and nevertheless such a reinforced structure that the rigid body embedded in the pallet receives almost all of the loads upon the synthetic resin pallet.

Further, there has been examined such a proposal that the synthetic resin pallet is molded by mixing a reinforced fiber such as a glass fiber in the synthetic resin material as a main material of the synthetic resin pallet, is thus given a high strength against the flexure itself. If the fiber reinforced material is mixed in the synthetic resin pallet itself, there is a defect wherein the weight of the whole pallet becomes heavy, and besides a pallet decreases in its impact strength.

SUMMARY OF THE INVENTION

It is an object of the present invention, which was devised to obviate the problems inherent in the prior art, to provide a synthetic resin pallet capable of enhancing strength against bending force acting in a direction right-angled to a loading surface without an increase in weight of the whole pallet.

To accomplish the above technical object, according to the present invention, a synthetic resin pallet characterized in that a reinforced tape using a fiber reinforced material is attached for reinforcement by heat welding inside a groove formed on any one or both of surfaces of a synthetic resin pallet in order to resist a bending force acting in a direction orthogonal to the surface thereof and the reinforced tape itself attached by the heat welding to the synthetic resin pallet is bendable.

The synthetic resin pallet of the present invention comprises the indispensable components described above, however, the present invention is established in a case where the components thereof are specifically the following components. Of the specific components, the fiber reinforced material constituting the reinforced tape is a long fiber of 10 mm or longer.

Moreover, in the synthetic resin pallet according to the present invention, a glass fiber or a carbon fiber may be exemplified as the long fiber.

Further, in the synthetic resin pallet according to the present invention, a double-layered structure band composed of two layers formed by laminating an anti-slip layer on the reinforced tape using the fiber reinforced material, is fitted and welded inside a groove formed in a loading surface of the synthetic resin pallet, and an upper portion of the anti-slip layer on the upper side slightly protrudes from the loading surface.

In the synthetic resin pallet according to the present invention, a groove is formed in the lower surface or the loading surface of the synthetic resin pallet, and the reinforced tape composed of the fiber reinforced material is fitted into the groove and welded by heat. On this occasion, the reinforced tape is disposed extending in direction of the two side ends of an imaginary elastic curve due to a flexure within a plane orthogonal to a bending direction of the synthetic resin pallet.

With this contrivance, when the synthetic resin pallet is stored in a rack with the right-and-left ends being supported at two points in, e.g., an automated warehouse, the reinforced tapes resist the creep, and hence creep deflection of the synthetic resin pallet can be reduced. Besides, the reinforced tapes themselves are comparatively light in weight, and, even when attached to the synthetic resin pallet, it never happens that a weight of the pallet conspicuously increases.

DESCRIPTION OF THE PREFERRED EMBODIMENTS

Figure 1:
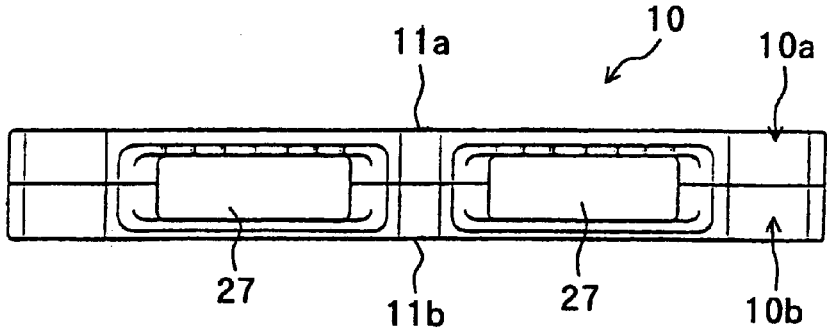
FIG. 1 is a side view sowing a four-way synthetic resin pallet in one embodiment of the present invention.
Figure 2:
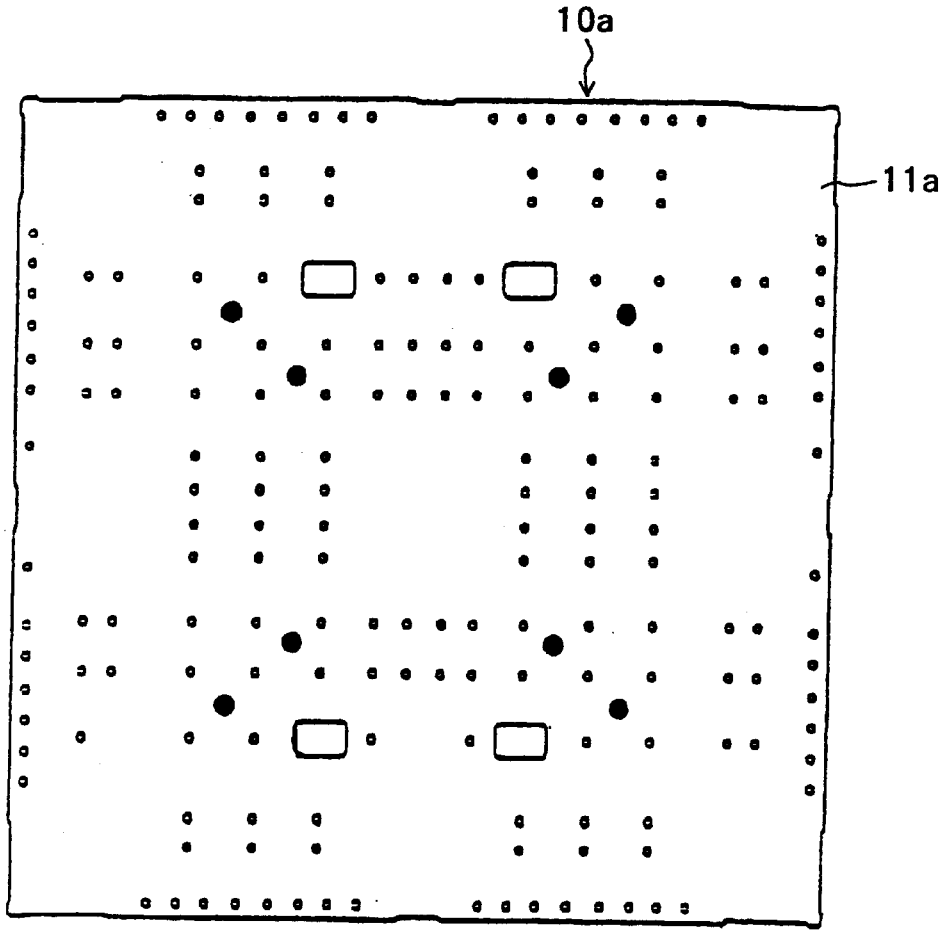
FIG. 2 is a plan view showing a surface of a deck board of a top pallet constructive member, in which the synthetic resin pallet shown in FIG. 1 is divided into upper and lower members.
Figure 3:
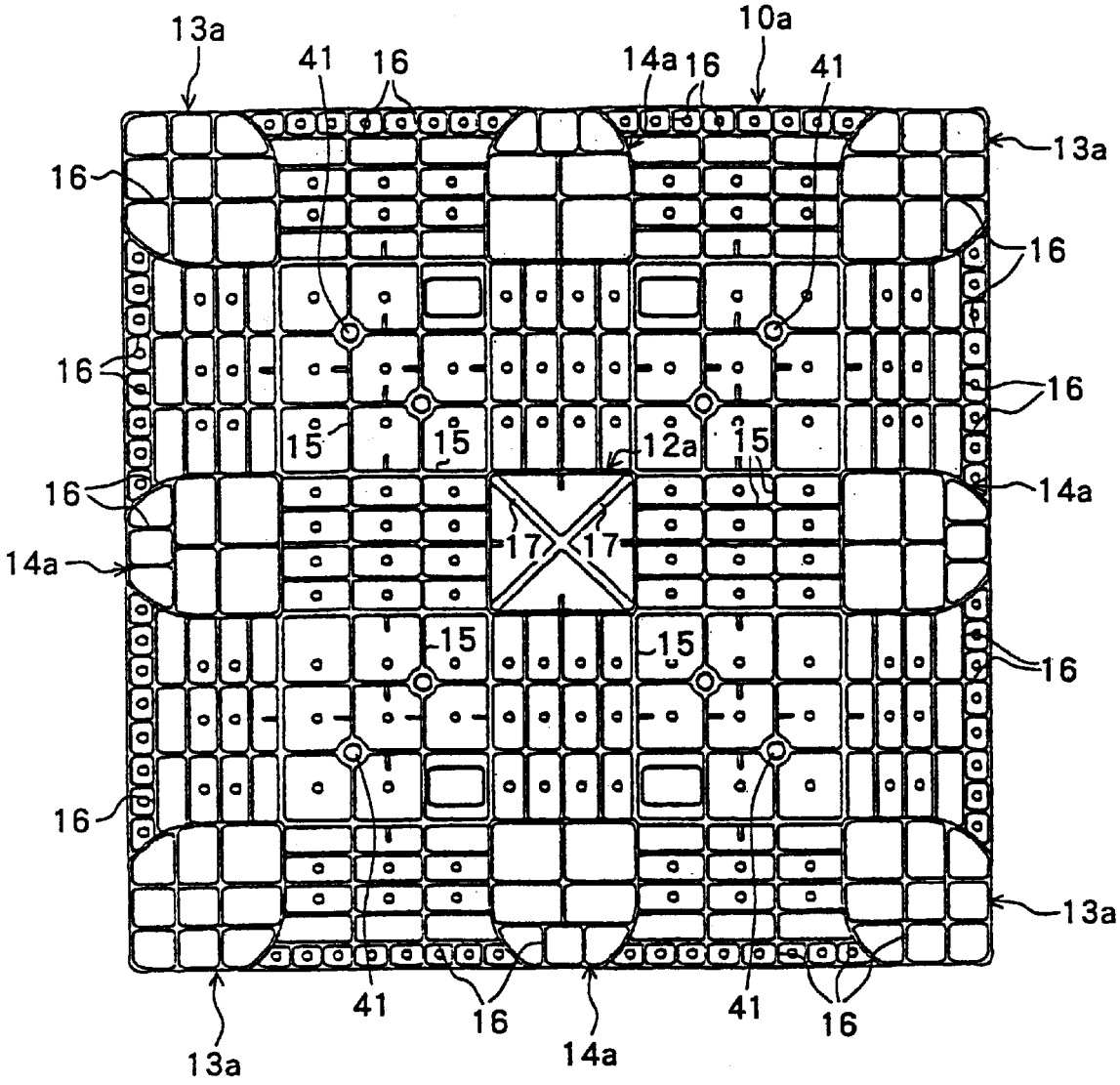
FIG. 3 is a plan view showing an internal surface of the top pallet constructive member shown in FIG. 2.
Figure 4:
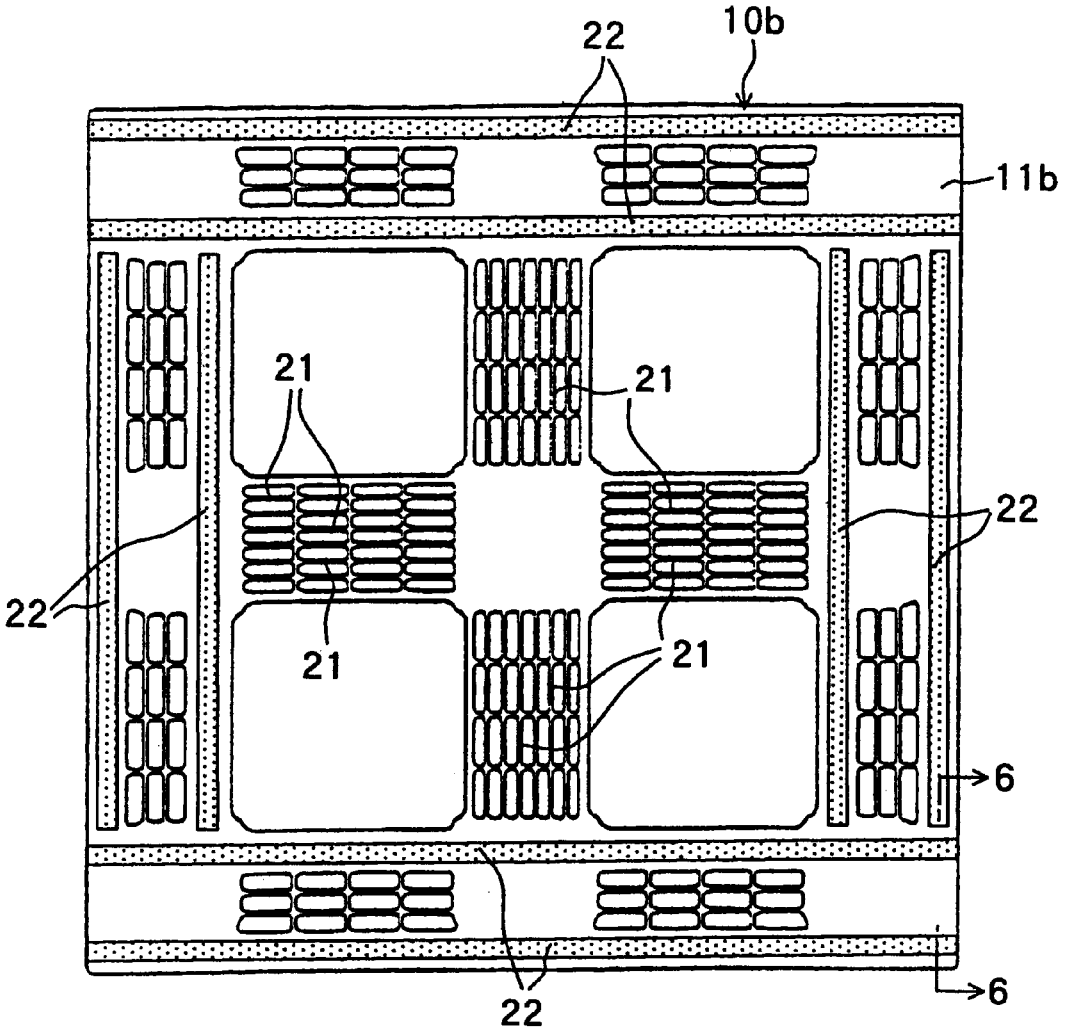
FIG. 4 is a plan view showing a bottom surface of a plate member of the bottom pallet constructive member, in which the synthetic resin pallet shown in FIG. 1 is divided into the upper and lower members.
Figure 5:
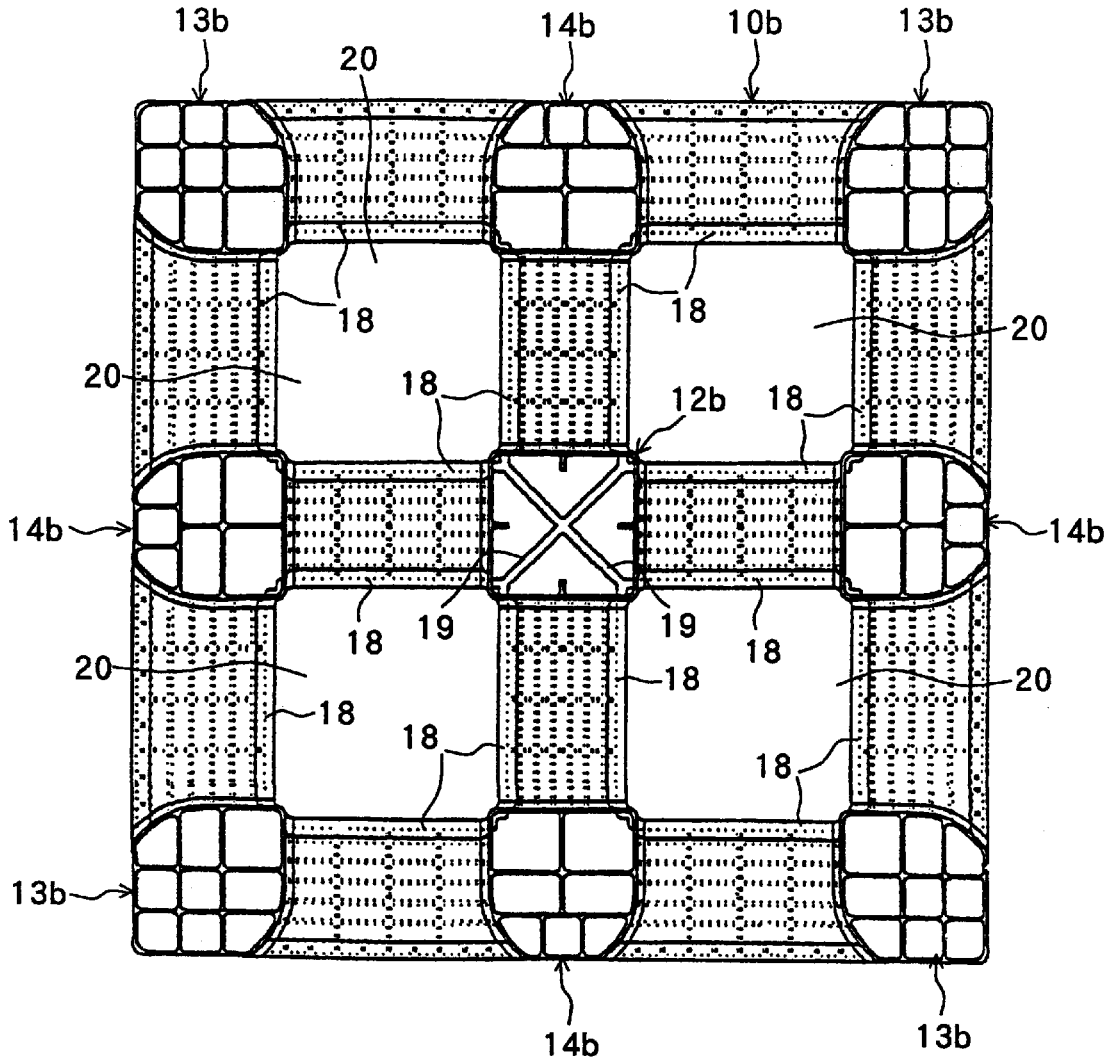
FIG. 5 is a plan view showing an internal surface of the bottom pallet constructive member shown in FIG. 4.

Next, a synthetic resin pallet according to the present invention will be described in greater details by way of embodiments illustrated in the drawings. FIG. 1 is a side view showing a four-way synthetic resin pallet 10 in one embodiment of the present invention. FIG. 2 is a plan view showing an external portion, i.e., a deck board surface of a pallet constructive member 10*a* serving as a top board, wherein the synthetic resin pallet 10 is divided into an upper half and a lower half. FIG. 3 is a plan view showing an internal configuration of the pallet constructive member 10*a*. FIG. 4 is a plan view showing an external surface of a plate member of a pallet constructive member 10*b* serving as a bottom board. FIG. 5 is a plan view showing an internal surface of the plate member of the pallet constructive member 10*b* as the bottom board.

As illustrated in FIGS. 1 through 3, the top pallet constructive member 10*a* is constructed of a deck board 11*a* and nine pieces of leg constructive members 12*a*, 13*a*, 14*a* arrayed orderly lengthwise and crosswise at predetermined intervals inwardly of the deck board 11*a*. More specifically, among these nine pieces of leg constructive members 12*a*–14*a*, the reference numeral 12*a* indicates one single central leg constructive member provided at the center of the top pallet constructive member 10*a* and taking substantially a square in section.

Further, corner leg constructive members designated by 13*a* are provided at for corners inwardly for the deck board 11*a* so as to surround the central leg constructive member 12*a*. Intermediate leg constructive members 14*a* are provided at intermediate portions between the respective corners along an inside peripheral edge of the deck board 11*a*.

Reinforced ribs 15 are provided in lattice intersecting lengthwise and crosswise in an imaginary area (a central area) connecting internal angular points of the corner leg constructive members 13*a* formed on the internal surface of the top pallet constructive member 10*a*. The reinforced ribs 15, which are thus formed on the internal surface of the deck board of the top pallet constructive member 10*a*, contribute to enhance a flexural strength of the deck board 11*a*.

Further, reinforced ribs 16 are provided intersecting lengthwise and crosswise in an area (an outer peripheral area) outside the above-described central area on the internal surface of the deck board of the top pallet constructive member 10*a*. Moreover, these reinforced ribs 16 are provided also inwardly of the corner leg constructive members 13*a* and of the intermediate leg constructive members 14*a*. Thus, the reinforced ribs 16, which are formed in the outer peripheral area on the internal surface of the deck board of the top pallet constructive member 10*a*, contribute to enhance an impact strength against impacts exerted from outside of the synthetic resin pallet 10 and from the outside of the leg members.

Ribs 17 for a gas flow are formed along diagonal lines inwardly of the central leg constructive member 12*a*, and ends of these gas flow ribs 17 are connected to the reinforced ribs via walls of the central leg constructive member 12*a*. As a result, at least a large proportion of the reinforced ribs 15 provided in the central area of the top pallet constructive member 10*a* are connected to the gas flow ribs 17 disposed in cross within the central leg constructive member 12*a*, and a hollowed portion, i.e., a gas channel (not shown) is formed inside the reinforced rib 15 connected to the gas flow rib 17.

Namely, as described above, the great majority of reinforced ribs formed on the central area surface of the deck board 11*a* turn out to be hollowed ribs by injecting the gas from a position in the vicinity of the center of the pallet constructive member 12*a* after the injection molding. Note that the reinforce ribs 16 provided on the outer peripheral area surface of the deck board 11*a*, of which width and pressure of injected gas or volume of injected gas are adjusted, thereby become hard to form the gas channels therein, and as a result, there might be a large number of solid ribs.

The reinforced ribs 15 are thus hollowed, thereby making it feasible to obtain effects such as reducing a weight of the synthetic resin pallet, dimensional fluctuation, and a molding time as well. Further, the ribs on the outer peripheral area surface are filled with a large amount of resins by the gas pressure (there becomes a state of holding pressure being applied), thereby exhibiting such an extremely excellent effect that a sink mark does not occur in the surface of the plate members in the position which the solid rib is provided in the internal surface thereof, when in a cooling process.

On the other hand, a bottom pallet constructive member 10*b* shown in FIGS. 1, 4 and 5 are likewise provided with a central leg constructive member 12*b*, corner leg constructive members 13*b* and intermediate leg constructive members 14*b* inwardly of a plate member 11*b*. The central leg constructive member 12*b* and the leg constructive members 13*b*, 14*b* peripheral thereto are absolutely the same as the leg constructive members 12*a*, 13*a*, 14*a* in terms of the forming positions, the sectional configurations and sizes thereof.

When viewing one-fourth of this bottom pallet constructive member 10*b* imaginarily divided by a lengthwise central line and a crosswise central line each extending through the center of the central leg constructive member 12*b*, reinforced ribs 18 formed in an annular shape in positions substantially inscribed to the four leg constructive members 12*b*, 13*b*, 14*b*. Then, ribs 19 for a gas flow are formed along diagonal lines inwardly of the central leg constructive member 12*b*, and ends of these gas flow ribs 19 are connected to the annular reinforced ribs 18 in the four sections via walls of the central leg constructive member 12*b*.

Further, as in the case of the top pallet constructive member 10*a*, a gas inlet is eventually formed at a cross point between the gas flow ribs 19 formed along the diagonal lines inwardly of the central leg constructive member 12*b*. Consequently, as in the case of the reinforced ribs 15 described above, the hollowed portions, viz., the gas channels are formed in side the reinforced ribs 18 positioned in the central area on the internal surface of the plate member 11*b* and connected to the gas flow ribs 19.

Note that an opening 20 is formed in an area defined by the reinforced ribs 18 formed in positions substantially inscribed to the four leg constructive members 12*b*, 13*b*, 14*b* in each one-fourth section described above. This opening 20 serves as port from which a wheel enters and exits when the synthetic resin pallet is handled by a pallet truck.

Moreover, in the bottom pallet constructive member 10*b* having the openings 20 serving as the wheel in-and-out ports of the pallet truck, a multiplicity of reinforced ribs 21 (FIG. 4) are formed on the surface of the plate member 11*b* but are not formed with the gas channels, and therefore have solid interiors.

A plurality of reinforced tapes 22 are provided on the surface of the plate member 11*b* of the thus constructed bottom pallet constructive member 10*b*. This reinforced tape 22 is composed of a fiber reinforced material. To describe this reinforced tape 22 in greater details, the reinforced tape 22 is molded in a predetermined configuration by mixing long glass fibers having a length of over approximately 10 mm with the base material of synthetic resin.

The synthetic resin material as the base material involves the use of a thermally adhesivable material with respect to the synthetic resin pallet 10, preferably, the same kind of material as the synthetic resin pallet 10 in terms of thermally welding the reinforced tape 22 to the synthetic resin pallet 10. It is preferable in terms of a recycling of damaged synthetic pallet 10 that the same kind of resin material as the synthetic resin pallet is used as the base material of the reinforced tape 22.

An adhesive resin (APO) modified by carboxylic acid is mixed as a binder for obtaining a good adhesion between the long glass fiber and the base material. The content of long glass fiber and a thickness of the reinforced tape itself are properly designed so that a flexural modulus of the reinforced tape 22 itself is over approximately 50,000 $Kg/cm^2$, preferably approximately over 100,000 $Kg/cm^2$. On this occasion, it is desirable that the long glass fibers be oriented in the lengthwise direction of the reinforced tape 22, however, the orientation is not limited to this direction.

Figure 6:
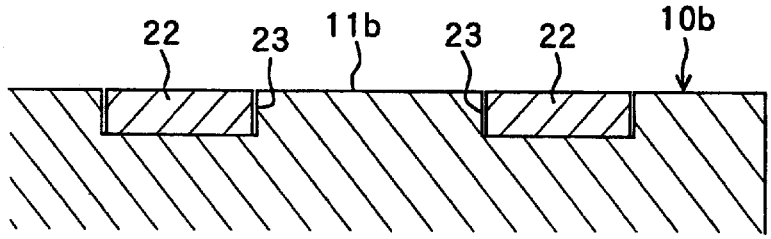
FIG. 6 is a fragmentary sectional view of the bottom pallet constructive member shown in FIG. 4, taken along the line 6—6.

The reinforced tape 22 is, as illustrated in FIG. 6, fitted into grooves 23 formed in right-and left directions as viewed in FIG. 4 and thermally welded to bottom and side surfaces thereof, and thus fixed to the surface of the plate member 11*b*. The reinforced tape 22, material itself (the reinforced tape itself), is formed in a mode of having a flexibility and being bendable.

More specifically, the reinforced tape 22 is required to have such physical properties that flexural deflection is over 2 mm with a load of 10 Kg when 3-point bending test at a span of 10 cm (a test of applying load at the middle of the span of 10 cm) with respect to the reinforced tape 22, and tensile elongation is less than 5% when the load of 500 kg is applied to the reinforced tape when the reinforced tape 22 having a certain length hangs in a perpendicular direction with a load on the order of 500 Kg applied to a lower end thereof and thus stretched, a stretch thereof is under 5% of the entire length of the reinforced tape 22.

Figure 7:
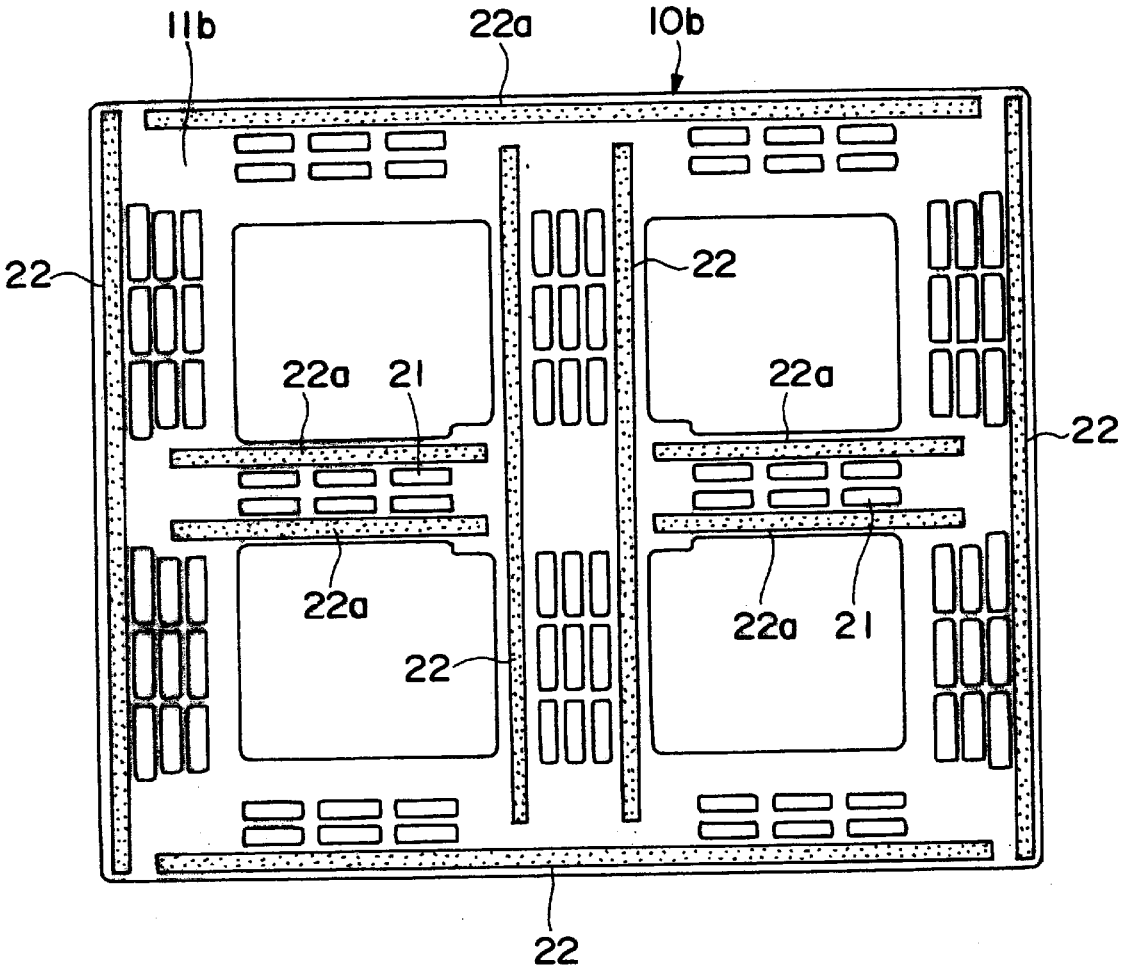
FIG. 7 is a bottom view showing an example of how reinforced tapes are disposed on the synthetic resin pallet of the present invention.

The reinforced tape 22 is actually stuck to the synthetic resin pallet 10 by the heat welding, in which case it is preferable that a width (a) is 10–50 mm, and a thickness (b) is 0.5–5 mm in terms of considering a size of a normally used synthetic resin pallet 10. Generally, a/b is preferably on the order of 5 to 80. Further, in the case of using the synthetic resin pallet 10 stuck with the reinforced tape 22, as indicated by the reference numeral 22*a* in FIG. 7, it is required that the reinforced tape is disposed between the adjacent leg constructive members 12*a*, 13*a* or 14*a* at the minimum. As a matter of course, if there is a fitting space on the deck board or on the surface of the plate member of the synthetic resin pallet 10, as shown in FIGS. 4 and 7, it is preferable that the reinforced tape be disposed as long as possible, and a geometry of the reinforced tapes being disposed between the adjacent leg constructive members may also be replaced.

The synthetic resin pallet 10 in this embodiment is formed such that the leg constructive members 12*a*, 12*b*, 13*a*, 13*b*, 14*a*, 14*b* are fitted to each other with the top and bottom pallet constructive members 10*a*, 10*b* facing to each other, and those fitted portions are integrally welded. Thus, the top and bottom pallet constructive members 10*a*, 10*b* are set in the face-to-face relationship, and the leg constructive members 12*a*, 12*b*, 13*a*, 13*b*, 14*a*, 14*b* are fitted to each other and integrally welded, thereby forming the hollowed leg members. Spaces (holes) between those leg members serve as fork inlets 27.

Figure 8:
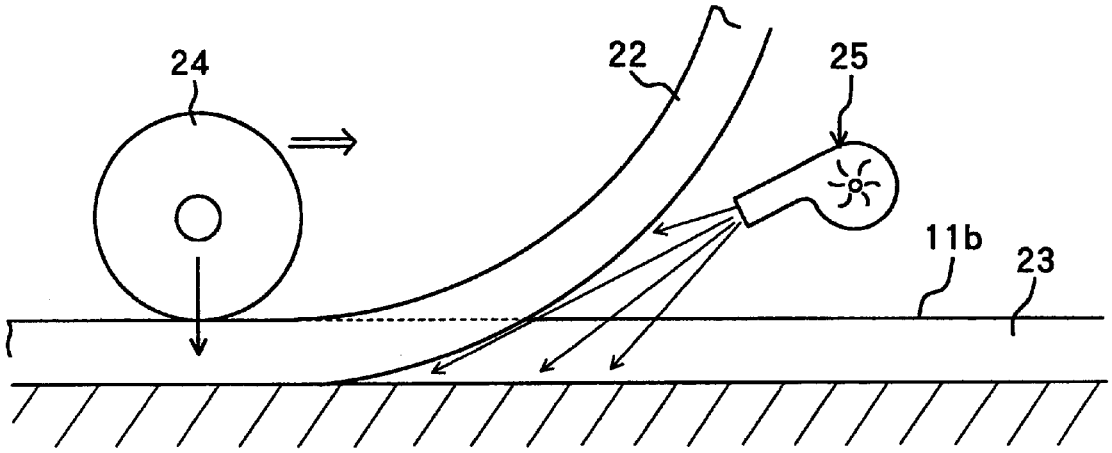
FIG. 8 is an explanatory view schematically showing a configuration in a state where the tape-like reinforced tape is fixed by heat welding in the groove formed in the surface of the plate member of the bottom pallet constructive member.

The reinforced tapes described above are attached to the surface of the plate member 11*b* of the bottom pallet constructive member 10*b* of the synthetic resin pallet 10 after or before integrally welding the top and bottom pallet constructive members 10*a*, 10*b*. An attaching method thereof is that the reinforced tape 22 is, as illustrated in FIG. 8, sequentially fitted into a groove 23 previously from in the surface of the plate member 11*b* from one end of the groove 23 toward a terminal end thereof while being fed out.

On this occasion, just before the reinforced tape 22 is fitted into the groove 23, a hot-air blower 25 welds contact surfaces of the reinforced tape and the groove by heating, and, immediately after fitting the reinforced tape 22 into the groove 23, a press roller 24 presses the upper part of the reinforced tape 22. The molten surface resin on the plate member 11*b* of the bottom pallet constructive member 10*b* is thereby integrally welded to the molten resin on the contact surface of the reinforced tape 22, and the reinforced tape 22 is firmly joined by a press-fitting force which is thereafter given by a press roller 24.

The above-described attaching method of attaching the reinforced tape 22 to the surface of the plate member lib of the bottom pallet constructive member 10*b*, is preferable in terms of the reinforced tape 22 itself exhibiting the flexibility. There can be considered a variety of methods of attaching the reinforced tape 22 to the synthetic resin pallet, such as a method involving the use of a heating bar in addition to the method described above.

Next, the resisting action of the reinforced tape 22 against the flexure of the synthetic resin pallet 10 will be explained.

The reinforced tape 22 serves to resist the flexure occurred in the synthetic resin pallet by utilizing a tensile strength inherent in the tape 22 itself, i.e., a flexure occurred, e.g., when the synthetic resin pallet is placed on a 2-point support rack in an automated warehouse and right-and-left ends thereof are supported. Hence, it is preferable that the reinforced tape 22 is so provided within the surface of the plate member 11*b* on the underside of the synthetic resin pallet as to stretch in bilateral end direction of an imaginary elasticity curve related to the flexure.

Figure 15:
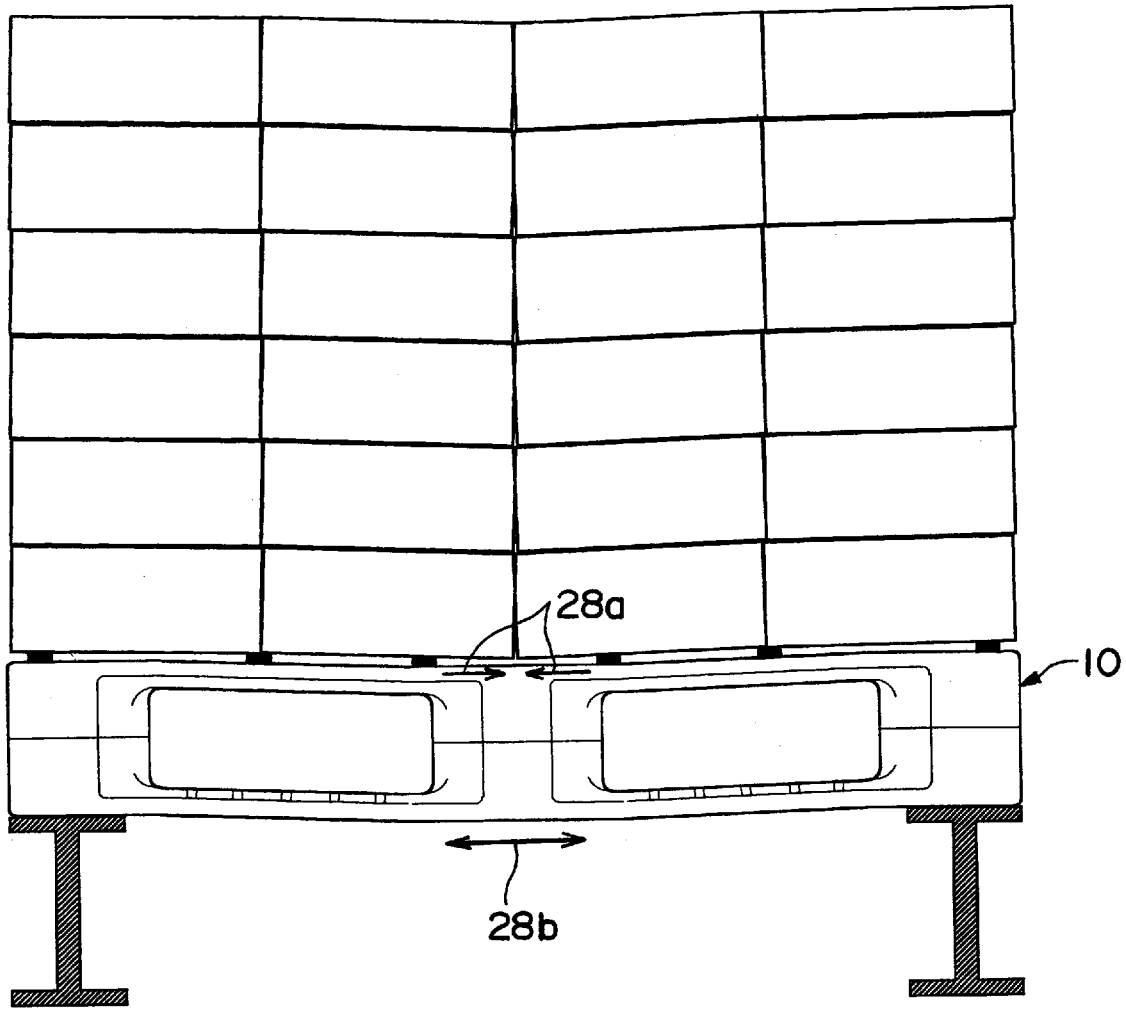
FIG. 15 is an explanatory view showing a configuration in a state where a flexure occurs in the synthetic resin pallet when the synthetic resin pallet loaded with goods is supported at two ends thereof.

In the thus constructed synthetic resin pallet 10, if the flexure occurs in the synthetic resin pallet 10 during a period for which the synthetic resin pallet 10 is supported on the 2-point support rack in the automated warehouse etc, as obvious from an arrowhead line 28*b* in FIG. 15, a tensile force acts in the right-and-left directions with respect to the plate member 11*b* of the bottom pallet constructive member 10*b* fitted with the reinforced tape 22, in other words, with respect to the bottom surface of the synthetic resin pallet 10.

Incidentally, the reinforced tape 22 using the fiber reinforced material is fixedly embedded into the groove 23 on the bottom surface of the synthetic resin pallet 10, and also therefore receives the tensile force. The reinforced tape 22 has, however, the large resisting force against the tensile force as described above and therefore formidably resists the tension. This implies resisting against the tensile force acting on the bottom surface of the synthetic resin pallet 10, thereby preventing a creep, viz., the flexure of the synthetic resin pallet 10. As a result, a creep deflection of the synthetic resin pallet 10 becomes considerably smaller than in the prior art.

Besides, in the synthetic resin pallet 10 in accordance with this embodiment, the flexural strength is enhanced by the reinforced tape 22 involving the use of the fiber reinforced material, whereby a weight of the pallet 10 can be reduced in combination with the hollowed reinforced ribs formed in the internal surface of the plate member 11*b* as well as in the internal surface of the deck board 11*a*.

By the way, in the synthetic resin pallet 10 in accordance with this embodiment, the reinforced tape 22 is joined and attached to the surface of the plate member 11*b* of the bottom pallet constructive member 10*b*. This is because the reinforced tape 22 has a larger strength against the tensile load than against a compressive load.

Namely, as explained above, the creep occurred by the synthetic resin pallet 10 being supported based on the 2-point support rack structure in the automated warehouse etc, flexes the synthetic resin pallet 10 downwards, and hence the compressive load acts on the deck board 11*a* of the upper surface, while the tensile load acts on the plate member 11*b* of the lower surface.

Figure 9:
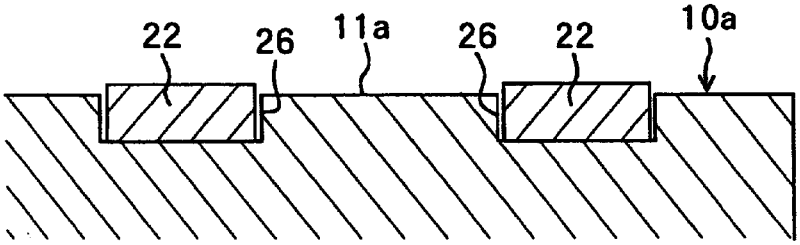
FIG. 9 is a sectional view, similar to FIG. 6, showing a state where the tape-like reinforced tape having a thickness to such an extent as to slightly protrude from the surface of the deck board, is fixed by the heat welding the groove formed in the surface of the deck board of the top pallet constructive member.

Therefore, the reinforced tape 22 having the larger strength against the tensile load, when attached to the lower surface of the synthetic resin pallet 10, i.e., to the surface of the plate member 11*b*, exhibits a higher effect by preventing the flexure from acting on the synthetic resin pallet 10. In the synthetic resin pallet according to the present invention, however, the reinforced tape 22 can be also attached to the upper surface of the synthetic resin pallet, viz., to the surface of the deck board 11*a* of the top pallet constructive member 10*a*. In that case, if the thickness of the reinforced tape 22 is, as shown in FIG. 9, so designed as to slightly protrude from the groove 26 formed in the surface of the deck board 11*a*, the reinforced tape 22 may serve to prevent slip of goods loaded on the surface of the deck board 11*a*.

Figure 10:
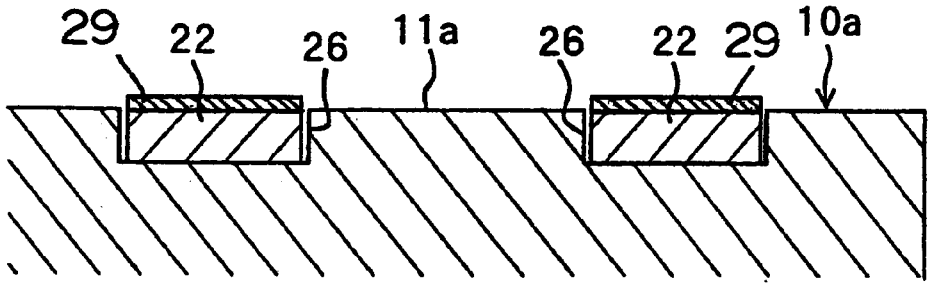
FIG. 10 is a fragmentary sectional view showing a state where a double-layered structure tape composed of two layers formed by laminating an anti-slip tape on the reinforced tape, is fitted and welded in the groove formed in the surface of the deck board of the synthetic resin pallet.

Further, what may also be structured is that as illustrated in FIG. 10, a double-layered structure tape composed of two layers formed by laminating an anti-slip tape 29 on the reinforced tape 22, is fitted into and welded to the groove 26 formed in the surface of the deck board 11*a*, and an upper part of the anti-slip tape 29 on the upper side slightly protrudes from the surface of the deck board 11*a*.

The embodiment discussed above has exemplified the four-way synthetic resin pallet 10, however, the present invention can be applied to a two-way synthetic resin pallet 30 as shown in FIGS. 11 through 14. The two-way synthetic resin pallet 30 has, though different in the number and configuration of the leg members from the four-way synthetic resin pallet 10 in the embodiment discussed above, basically the same construction.

Figure 12:
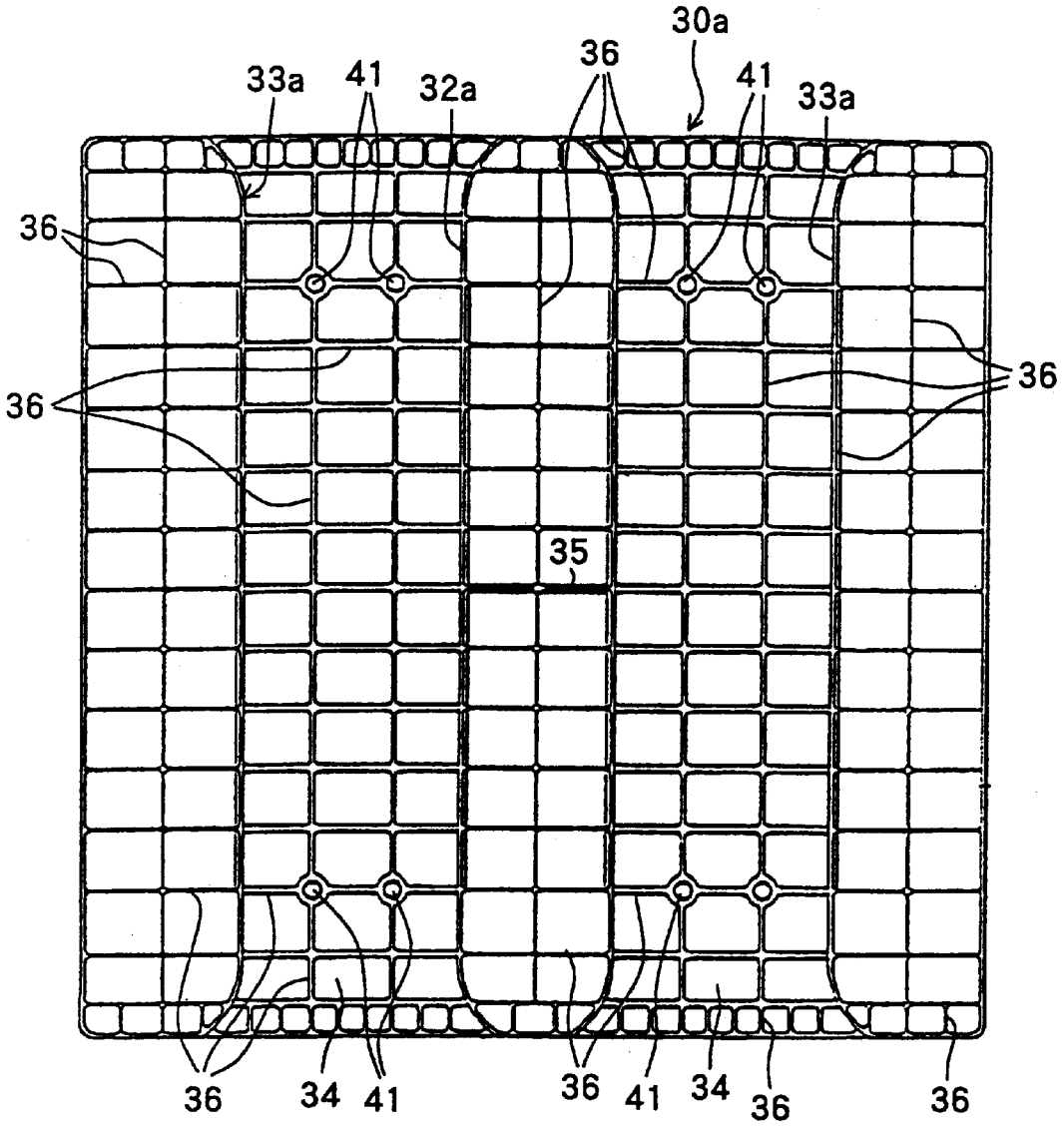
FIG. 12 is a plan view showing an internal surface of the top pallet constructive member shown in FIG. 11.
Figure 13:
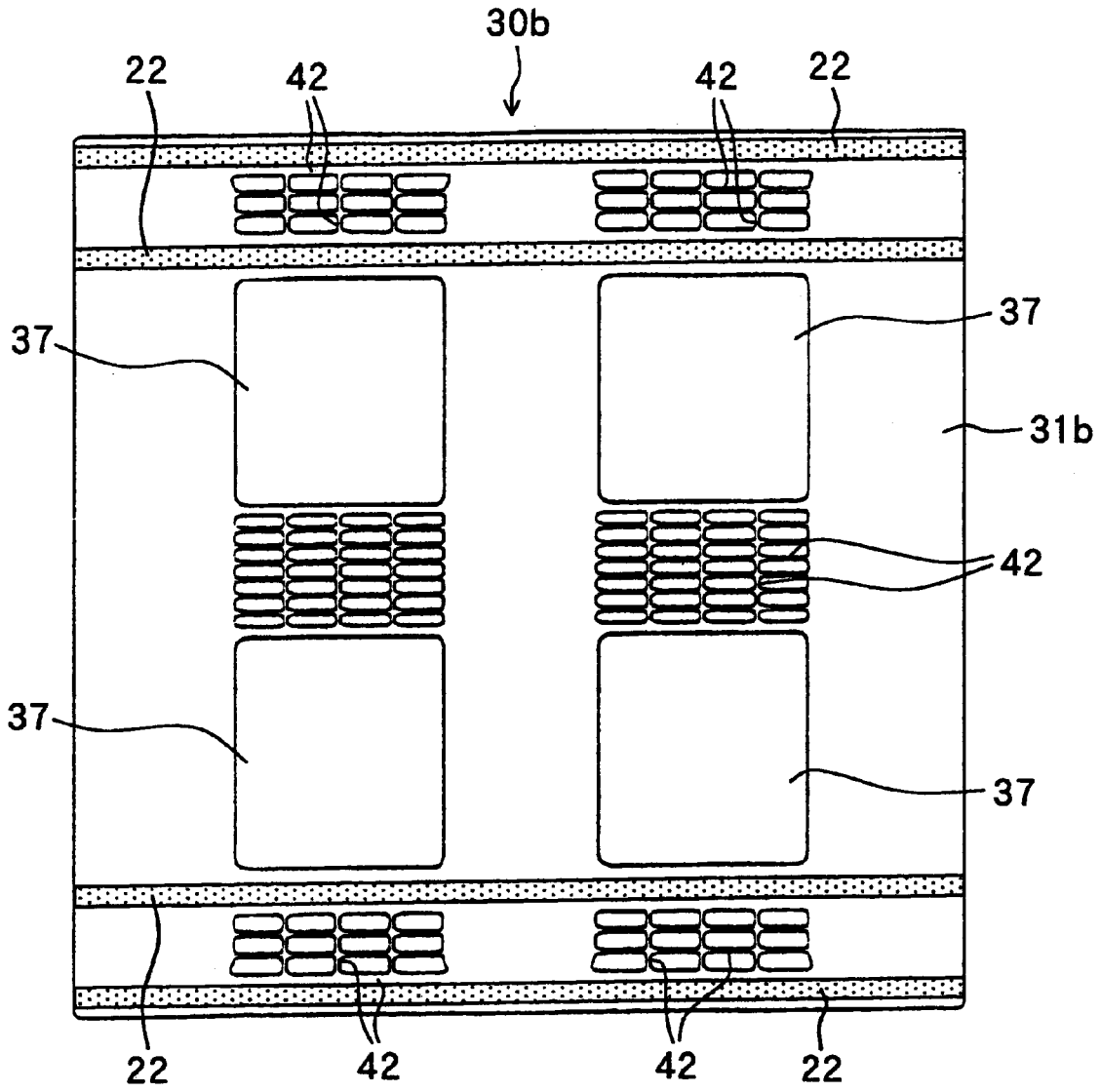
FIG. 13 is a plan view showing a bottom surface of the plate member of the bottom pallet constructive member, in which the synthetic resin pallet shown in FIG. 12 is divided into upper and lower members.
Figure 14:
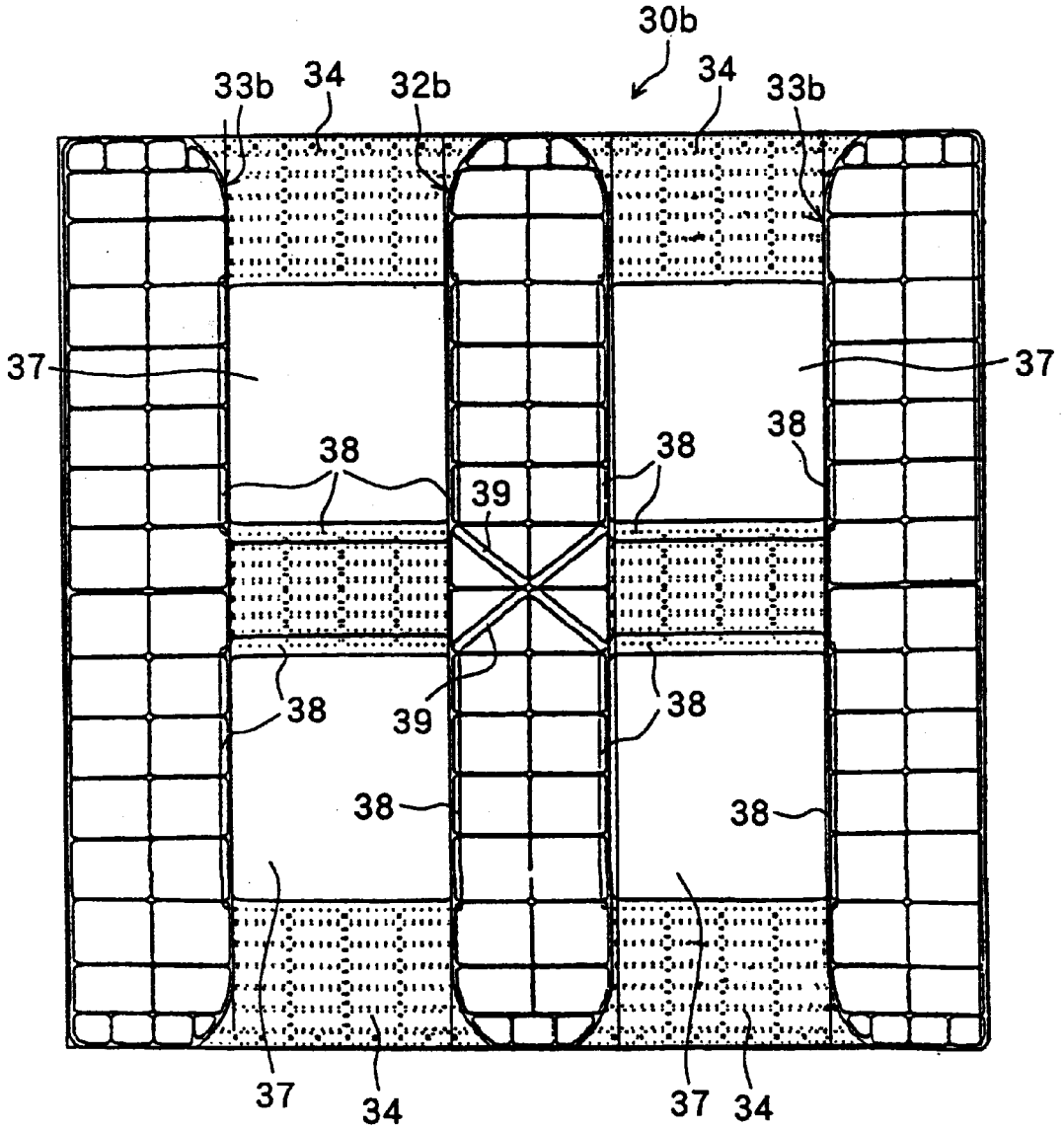
FIG. 14 is a plan view showing an internal surface of the bottom pallet constructive member shown in FIG. 13.

To be specific, in the two-way synthetic resin pallet 30, as obvious from FIGS. 12 and 14, three pieces of leg constructive members 32*a*, 33*a* and three pieces of leg constructive members 32*b*, 33*b* each taking a cylindrical shape, are arranged on the internal surfaces of a deck board 31*a* and of a plate member 31*b* of pallet constructive members 30*a*, 30*b*.

That is, to explain how those leg constructive members are disposed on one single pallet constructive member 30*a*, side leg constructive members 33*a* are formed along a pair of peripheral edges (sides) facing to each other on the internal surface of the deck board 31*a* of the top pallet constructive member 30*a*, and the central leg constructive member 32*a* is provided in a middle position therebetween.

Then, the two-way synthetic resin pallet 30 is also formed such that the leg constructive members 32*a*, 32*b* and 33*a*, 33*b*, 33*b* are fitted to each other with the top and bottom pallet constructive members 30*a*, 30*b* facing to each other, and those fitted portions are integrally welded. Thus, the top and bottom pallet constructive members 30*a*, 30*b* are set in the face-to-face relationship, and the leg constructive members 32*a*, 32*b* and 33*a*, 33*b* are fitted to each other and integrally welded, thereby forming the hollowed leg members 32, 33. Spaces (holes) between those leg members serve as fork insertion holes 34.

A reinforced rib 35 is provided so that the rib 35 extends in a crosswise direction of the central leg constructive member 32*a* on a longitudinal bisector of the central leg constructive member 32*a* provided on the internal surface of the deck board 31*a* of the top pallet constructive member 30*a*, and two ends thereof are connected to wall surfaces. A lengthwise bisecting position of the reinforced rib 35 is the center of the central leg constructive member 32*a* as well as being the central point of the top pallet constructive member.

Reinforced ribs 36 are provided in lattice intersecting lengthwise and crosswise, including interiors of the central leg constructive member 32*a* and of the side leg constructive members 33*a*, on the thus structured internal surface of the top pallet constructive member 30*a*. All these reinforced ribs 36 are connected to the reinforced ribs 35 described above. Then, the reinforced rib 36 existing in the central area is hollowed, and therefore the gas is injected to the reinforced rib 35 from the central point described above. Accordingly, the reinforced rib 35 functions also as a gas flow rib.

On the other hand, an opening 37 from which the wheel of the pallet truck enters and exits is, as in the case of the synthetic resin pallet 10 in the embodiment illustrated in FIGS. 1–5, formed in the inside surface of the plate member 31*b* of the bottom pallet constructive member 30*b*. The openings 37 are, as apparent from FIG. 13, so provided by twos as to be spaced away from each other above the respective fork insertion holes 34 formed by the central leg constructive member 32*b* and the side leg constructive members 33*b*.

Reinforced ribs 38 are formed at side edges, on the adjacent side, of the two openings 37 formed side by side above the fork insertion holes, and at inside proximal portions of the wall surfaces of the two leg constructive members 32*b*, 33*b* along the side edges of the opening 37. Namely, it follows that the reinforced ribs 38 are formed along the three side edges of each opening 37, and these three pieces of reinforced ribs 38 are continuous.

Then, a central position on an imaginary longitudinal bisector of the central leg constructive member 32*b*, is the central point of the bottom pallet constructive member 30*b* as in the case of the top pallet constructive member 30*a* described above, and gas flow ribs 39 are provided in cross with the above central point serving as a cross point thereof. Ends of these gas flow ribs 39 are connected to the ends of the reinforced ribs 38 provided along the side edges, on the adjacent side, of the two openings 37 formed in the side-by-side relationship above the form insertion holes 34.

As for the gas injection with respect to the bottom pallet constructive member 30*b*, the gas is injected from the cross point of the gas flow ribs 39 taking the cross shape, i.e., from the central point of the bottom pallet constructive member 30*b*. The gas enters the reinforced ribs 38 via the gas flow ribs 39, and gas channels are formed in interiors thereof. In the thus structured two-way synthetic resin pallet 30 also, the gas channels are formed mainly in the reinforced ribs existing in the central area (defined b y the four openings 37), while the reinforced ribs existing outer peripheral areas outside the central area are excluded as the gas channel forming ribs.

With this contrivance, the synthetic resin pallet 30 is given characteristics of exhibiting a high flexural strength with respect to especially the deck board 31*a* or the plate member 31*b* in the central area, and particularly a high impact strength in the outer peripheral areas, and besides a reduction in weight of the pallet 30 can be attained. The reinforced tape 22 are, as in the embodiment discussed above, provided together with a multiplicity of reinforced ribs 42 partially formed with the gas channels on the bottom surface of the plate member 31*b* of the bottom pallet constructive member 30*b* of the two-way synthetic resin pallet 30.

Note that the two-way synthetic resin pallet 30 does not also cause a decline of an impact resistance of the angular portions of the pallet because of no gas flow round the wall surfaces of the leg constructive members formed on the outer surfaces at the four corners of the deck board 31*a*.

An injection molding condition of the pallet constructive members 10*a*, 10*b* or 30*a*, 30*b* will be explained. The injection molding condition of the pallet constructive members may be a normal condition, wherein a melting temperature (a cylinder temperature) is preferably 200~250° C., and an injection rate is on the order of 2,000~5,000 cc/sec in the case of using, e.g., high-density polyethylene as a material. Further, polyolefine such as polyethylene, polypropylene and ethylene-propylene copolymer etc is typical as a synthetic resin of which the pallet is composed, and, as a matter of course, other resins may also be use as the case may be.

Further, it is also taken for granted that there are properly used additive agents such as coloring agents and fillers etc. Moreover, a conventionally-known foaming agent including organic or inorganic foaming agents which are normally used, may be mixed in one of those synthetic resins to form a foaming body. In that case, it is desirable that a foaming rate be on the order of 1.01~1.4 times. In that instance, an apparent density of the whole pallet may be 0.65~0.95 times a density of the raw synthetic resin.

Figure 11:
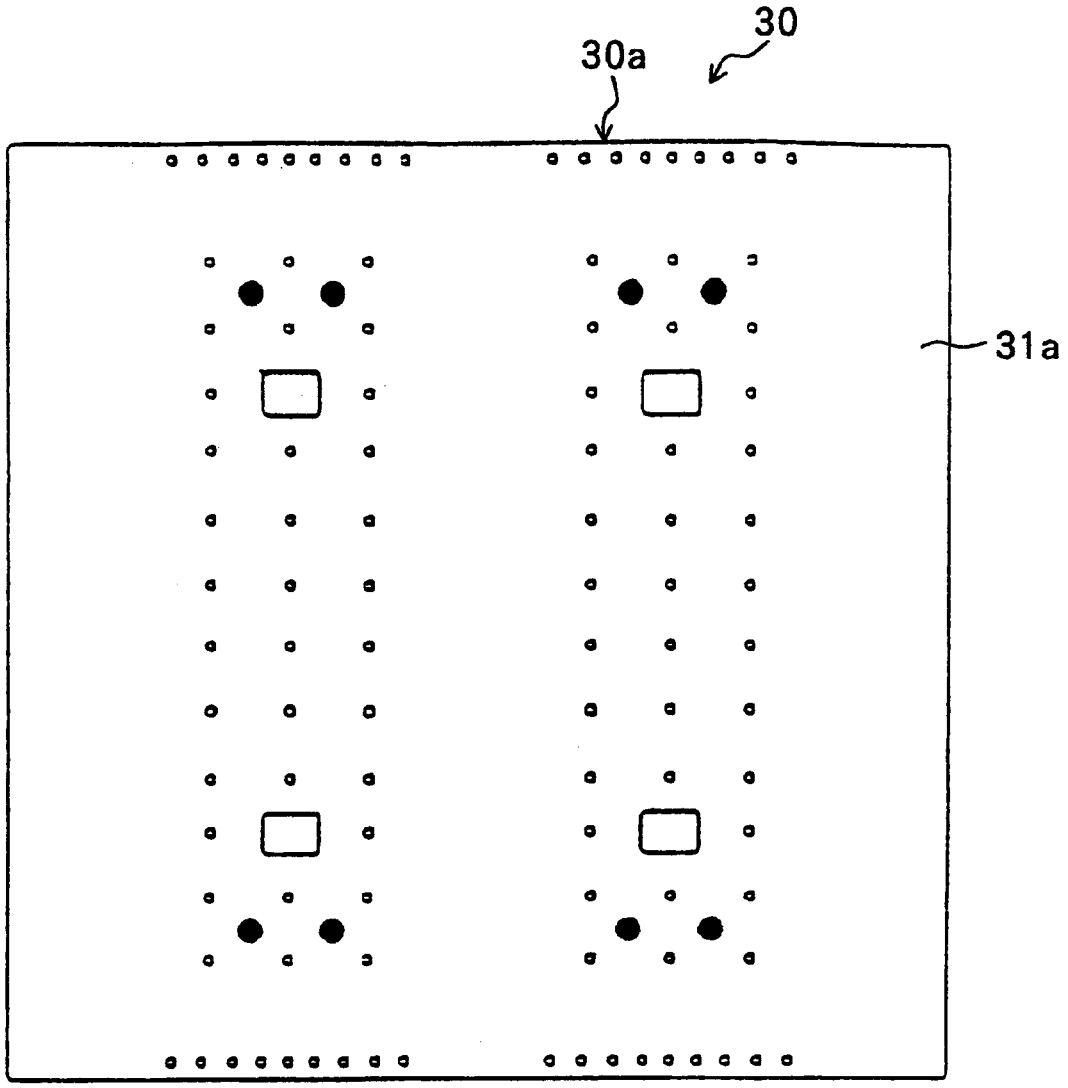
FIG. 11 is a plan view showing the surface of the deck board of the top pallet constructive member, in which a two-way synthetic resin pallet in another embodiment of the present invention is divided into upper and lower members.

Note that the numeral 41 in FIGS. 3 and 11 designates an anti-slip grommet press-fitted into a hole formed at the intersection of the reinforced ribs provided on the inner surface of the deck board so as not to cause a relative slip between the fork and the synthetic resin pallet when inserting the fork into the fork insertion hole on the occasion of using the present synthetic resin pallet.

In the synthetic resin pallet in each embodiment of the present invention discussed above, the sectional configuration of the reinforced rib is not particularly limited. For example, there may be used a reinforced ribs of which a side surface is formed as a curvilinear surface, and reinforced ribs assuming a variety of sectional configurations such as a trapezoidal or semicircular shape and so on.

Further, the reinforced rib existing in the central area is provided with a bent portion formed at a thickest portion in the vicinity of the intersection with the deck board, and a size of this bent portion is properly designed, whereby a size of the hollowed portion formed by the gas injected thereinto when in the molding process can be controlled. This implies that the portion vicinal to the intersection with the deck board is formed as the curved portion, and the gas flow is smoothed by increasing the substantial wall thickness of the curved portion, thereby facilitating the formation of the gas flow passageway. As a result, the gas can be flowed to a location intended.

Note that each embodiment discussed above has exemplified the synthetic resin pallet formed by forming the top and bottom pallet constructive members by the injection molding, and making those pallet constructive members face to each other and integrally welding them. The present invention is not, however, limited to the synthetic resin pallet formed by the above-described method in terms of only such a point as to enhance the flexural strength by attaching the reinforced tape using the fiber reinforced material to the surface of the synthetic resin pallet.

As discussed above, according to the synthetic resin pallet of the present invention, the reinforced tape formed by use of the fiber reinforced material and is bendable with high resisting force against a tensile force is attached to any one or both of the upper and lower surfaces of the pallet, thereby enhancing the strength against the flexure of the synthetic resin pallet. It is therefore feasible to give such a characteristic creep deflection caused when supported by the two-point support rack for a long period of time in, e.g., the automated warehouse, is smaller than in the prior art, and besides to attain the reduction in weight thereof.

What is claimed is:

1. A synthetic resin pallet comprising:

at least one groove formed in any one an upper surface, a lower surface, and both upper and lower surfaces of said synthetic resin pallet; and a reinforced tape made of a fiber reinforced material, said reinforced tape being fixedly embedded into said at least one groove for reinforcement, without significantly increasing a weight of said synthetic resin pallet, thereby resisting a bending force acting in a direction orthogonal to said upper surface and said lower surface of said synthetic resin pallet, wherein said reinforced tape is bendable so that flexure of said synthetic resin pallet is prevented by said reinforced tape resisting said tensile force and wherein said reinforced tape is embedded into said at least one groove so that a long dimension of said reinforced tape is parallel with said upper surface of said synthetic resin pallet.

2. The synthetic resin pallet according to claim 1, wherein said fiber reinforced material constituting said reinforced tape is a long fiber of 10 mm or longer.

3. The synthetic resin pallet according to claim 2, wherein said long fiber is any one of a glass fiber and a carbon fiber.

4. The synthetic resin pallet according to any one of claims 1 to 3, wherein a double-layered structure tape, composed of two layers formed by laminating an anti-slip tape on a first surface of said reinforced tape, is fitted into said at least one groove formed in any one of said upper surface, said lower surface, and both said upper and lower surfaces of said synthetic resin pallet so that a second surface of said reinforced tape contacts and is fixed by heat welding to a bottom surface of said at least one groove, and an upper surface of said anti-slip tape slightly protrudes from any one of said upper surface, said lower surface, and both said upper and lower surfaces of said synthetic resin pallet.

5. A synthetic resin pallet comprising:

at least one groove formed in any one of an upper surface, a lower surface, and both upper and lower surfaces of said synthetic resin pallet; and a reinforced tape made of a fiber reinforced material and fixedly embedded into said at least one groove for reinforcement, without significantly increasing a weight of said synthetic resin pallet, thereby resisting a bending force acting in a direction orthogonal to said upper surface and said lower surface of said synthetic resin pallet, wherein said reinforced tape is bendable so that flexure of said synthetic resin pallet is prevented by said reinforced tape resisting said tensile force, and wherein a double-layered structure tape, composed of two layers formed by laminating an anti-slip tape on a first surface of said reinforced tape, is fitted into said at least one groove formed in any one of said upper surface, said lower surface, and both said upper and lower surfaces of said synthetic resin pallet so that a second surface of said reinforced tape contacts and is fixed by heat welding to a bottom surface of said at least one groove, and an upper surface of said anti-slip tape slightly protrudes from any one of said upper surface, said lower surface, and both said upper and lower surfaces of said synthetic resin pallet.

* * * * *